United States Patent [19]

Nakatani et al.

[11] Patent Number: 4,799,442

[45] Date of Patent: Jan. 24, 1989

[54] METHOD OF AND APPARATUS FOR FEEDING FABRIC TO SEWING MACHINE

[75] Inventors: Toshio Nakatani; Atsumi Ohshima, both of Aichi, Japan

[73] Assignee: Nakanihon Juki Co., Ltd., Nagoya, Japan

[21] Appl. No.: 193,056

[22] Filed: May 12, 1988

Related U.S. Application Data

[62] Division of Ser. No. 47,382, May 8, 1987, Pat. No. 4,760,809.

[30] Foreign Application Priority Data

Jan. 7, 1987 [JP] Japan ..... 62-1386

[51] Int. Cl.[4] ..... D05B 21/00; D05B 1/00

[52] U.S. Cl. ..... 112/262.2; 112/262.3

[58] Field of Search ..... 112/262.2, 262.3, 121.15, 112/121.12, 121.26, 141, 147, 10

[56] References Cited

U.S. PATENT DOCUMENTS

| | | | |
|---|---|---|---|
| 3,736,895 | 6/1973 | Farar | 112/147 |
| 3,968,760 | 7/1976 | Rovin et al. | 112/262.2 X |
| 4,068,603 | 1/1978 | Arbter | 112/147 X |
| 4,098,201 | 7/1978 | Adamski et al. | 112/121.26 X |
| 4,098,204 | 7/1978 | Kojima | 112/121.26 X |
| 4,191,117 | 3/1980 | Della Tonne | 112/10 X |
| 4,265,187 | 5/1981 | Torre | 112/121.26 |
| 4,473,017 | 9/1984 | Letard et al. | 112/141 |
| 4,484,532 | 11/1984 | Norz | 112/121.26 X |
| 4,580,512 | 4/1986 | Nakatani et al. | 112/141 X |

*Primary Examiner*—H. Hampton Hunter

*Attorney, Agent, or Firm*—Robbins & Laramie

[57] ABSTRACT

A method of and an apparatus for feeding a cylindrical piece of fabric to a sewing portion of a sewing machine whereby a hem is set at the edge portion of the fabric as a twice-folded, three-layered band. The apparatus has parallel supports for the cylindrical fabric both secured to the sewing portion, and a plurality of pairs of clamp plates disposed to the left and right of the supports at forward and backward positions and movable to the left and right and back and forth. The cylindrical piece of fabric is supported around the supports and four pairs of clamp plates are moved in such a manner that the fabric portions are appropriately stretched and the fabric has a twice folded portion. With the left and right portions of the folded portion pressed by the backward pairs of clamp plates, the forward clamp plate pairs are removed from the fabric, and with the folded portion pressed in this way, the fabric is fed to the sewing portion where it is then pressed at a left or right portion thereof by means of another clamp plate. Finally, the backward clamp plate pairs and subsequently the last clamp plate are removed.

5 Claims, 12 Drawing Sheets

METHOD OF AND APPARATUS FOR FEEDING FABRIC TO SEWING MACHINE

BACKGROUND OF THE INVENTION

1. Field of the Invention

The present invention relates to a method of and an apparatus for feeding a piece of fabric to a sewing machine, and more particularly to a technique of feeding a piece of fabric previously formed as a cylindrical shape by sewing two opposite edges of the fabric together to a sewing portion of a sewing machine so as to sew a hem portion of the fabric after making one edge portion of the cylindrically shaped piece of fabric into a twice-folded, three layered band.

2. Description of the Prior Art

To perform so-called lapped-edge stitching (see FIGS. 12A, 12B, and 12C) by using a hem stitching sewing machine producing chain stitches, a fabric-edge lapping tool such as a twice folding tool and a fabric edge detector have conventionally been provided on the operator's side of the sewing portion of a sewing machine in the fabric feeding direction. Such lapped-edge stitching is performed in a so-called overlock stitching manner in which one edge portion of a cylindrically shaped piece of fabric is twice folded along the edge as to form a twice-folded three-layered band, and overcasting stitches are applied to the fabric so as to penetrate the thickness of the upper layer and of the fold forming middle and lower layers and also to enwrap the outer free edge of the upper layer. The fabric edge-lapping tool is operated manually when inserting the edge of a piece of fabric in order to form a twice-folded, three layered band. The fabric edge detector detects the edge of the fabric and operates in order to move the fabric horizontally while the fabric is being fed so that the overcasting stitches will accurately penetrate the fabric at the right locations.

The fabric edge-lapping tool and the fabric edge detector do not represent obstacles in the case of a flat-shaped piece of fabric. However, this is not true in the case of a cylindrically-shaped piece of fabric, particularly when the diameter of the cylinder is small. For instance, in the case of the cuff edge of a sleeve of a child's shirt, even if the sleeve is inserted around the cylindrically shaped bed of a so-called free arm sewing machine, the tool and the detector provided on the operator's side of the free arm will represent obstacles. More specifically, it has been extremely difficult and practically impossible to feed the fabric and accurately perform overlock stitching while manually inserting the edge of the fabric into the fabric edge-lapping tool and making the edge twice-folded, three-layered.

In order to eliminate these drawbacks, the present applicant has previously made proposals as disclosed in Japanese Patent Laid-Open Nos. 108081/1985 (corresponding to U.S. Pat. No. 4,580,512) and 122888/1986. According to these proposals, left and right supports are provided, and after one edge portion of a cylindrically shaped piece of fabric inserted around the supports has been made twice-folded and three-layered, the entire fabric is fed forward to a sewing portion of a sewing machine by moving the cylindrically shaped piece of fabric along the left and right supports and also moving the right support ahead together with the cylindrical piece of fabric. However, since the left support is secured to the frame of the sewing machine, while the right side of the inner peripheral surface of the fabric moves easily, the left side thereof is subjected to friction and moves only with difficulty. Consequently, the movement of the cylindrical piece of fabric differs in amount between the left and right sides, involving the risk that the twice-folded, three-layered band may collapse. In addition, because the right support moved ahead, a complicated and hence time-consuming operation of a plurality of clamps, particularly that of those on the right side, is required to enable the formation of the twice-folded, three-layered band and also the receiving and releasing of the fabric between these clamps.

SUMMARY OF THE INVENTION

Accordingly, an object of the present invention is to eliminate the drawbacks of the prior art by providing a method of feeding a piece of fabric to a sewing machine and an apparatus therefor which is adapted to feed the edge of the fabric to the sewing portion of the sewing machine after forming the piece of fabric into a cylindrical shape by sewing two opposite edges of the fabric and subsequently after forming one edge portion of the cylindrically shaped piece of fabric into a twice-folded, three-layered band by a mechanical operation. The method and the apparatus according to the present invention will, even if the cylindrical piece of fabric has a small diameter, render a conventional fabric edge-lapping tool unnecessary, eliminate manual handling of the fabric which has hitherto required skill, and is capable of feeding the edge of the fabric by accurately and mechanically folding the edge portion, as well as being capable of allowing the fabric to be fed smoothly without a fabric edge detector representing any obstacle, thus enabling accurate lapped-edge stitching using a hem stitch seam. Other objects of the present invention include allowing an accurate twice-folding of the edge of the fabric to be effected, stabilization of the hem stitching operation, and the ability to cope with a change in the diameter of a cylindrically shaped piece of fabric.

A further object of the present invention is to enable an even movement of a cylindrically shaped piece of fabric having a twice-folded three-layered edge portion to the sewing portion of the sewing machine by using a left support secured to the frame of the machine and a right extending body, both of which are employed in the previous proposals by the applicant that are disclosed in Japanese Patent Laid-Open Nos. 45384/1985 and 108081/1985, but without moving the right support ahead. This permits the cylindrically shaped piece of fabric to move toward the sewing portion in the state of being pressed while simplifying and, hence, curtailing the time required for the operation of clamp plates to clamp and stretch the fabric, and to release the clamping and the stretching.

DESCRIPTION OF THE PREFERRED EMBODIMENTS

Figure 1:
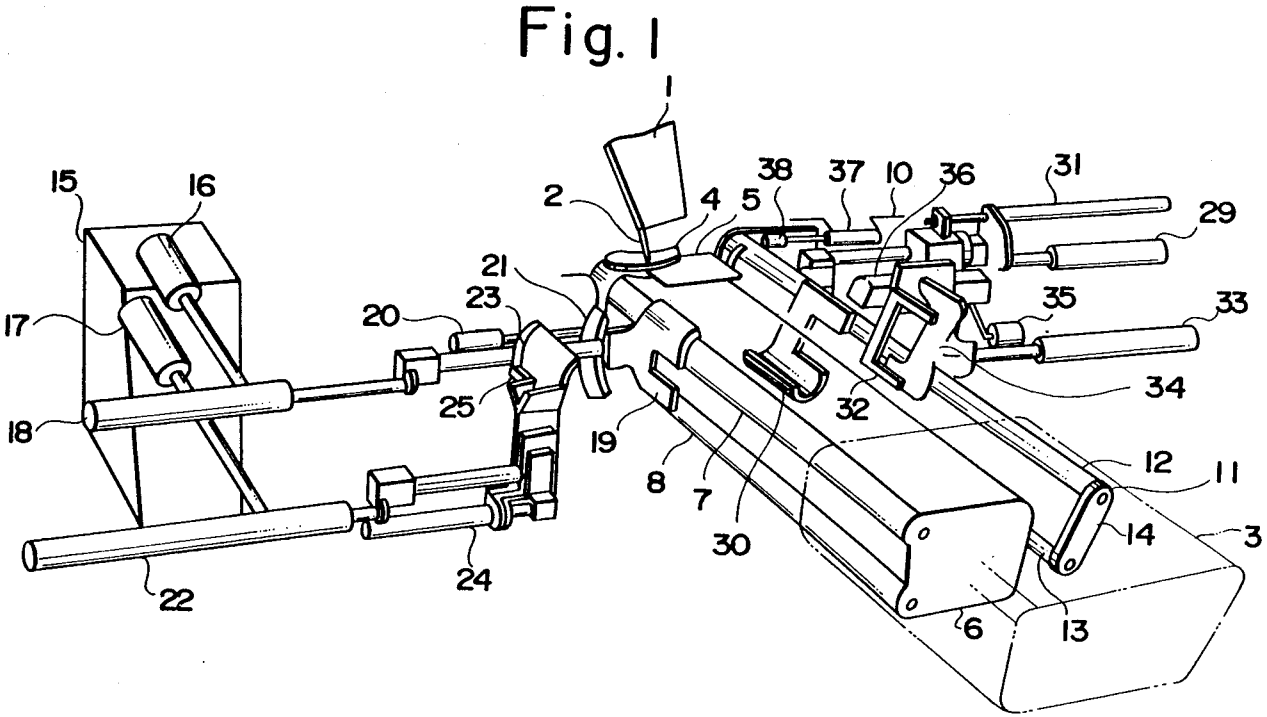
FIG. 1 is a perspective view of the overall apparatus according to the present invention, taken obliquely from the top left side.
Figure 2:
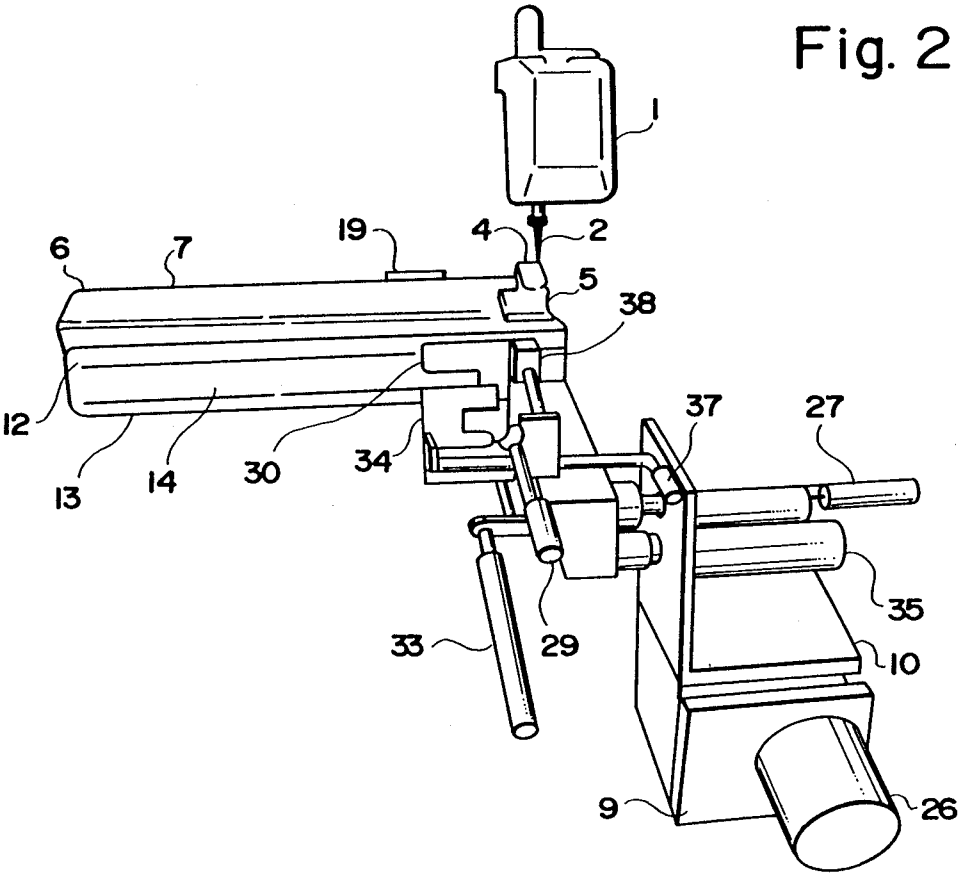
FIG. 2 is a perspective view of the same apparatus, taken obliquely from the top right side.

Description of an embodiment of the present invention will be made hereinunder with reference to the drawings. Reference is first made with respect to FIGS. 1 and 2.

The sewing machine to which the present invention is applied is an overlock stitching sewing machine of the type known as the free arm type. The sewing machine has a sewing portion with the following arrangement. An arm 1 of the sewing machine supports'a needle 2 for supporting an upper thread and movable vertically; and a presser foot 4 for pressing a piece of fabric 3 by means of a resilient force. A bed 5 for the fabric 3 supports the following: a looper (not shown) which is situated immediately below the needle 2 and operates in cooperation with the needle 2 to form a loop seam for an edge of the fabric by catching an upper thread loop created by the needle 2 through friction as the needle 2 rises after penetrating the fabric 3; and a feeding gear (not shown) which is situated below the presser foot 4 and operates by appearing and disappearing from the bed 5 while moving back and forth in such a way as to feed the fabric linearly in cooperation with the presser foot 4 while the fabric on the bed 5 is being held therebetween.

The bed 5 integrally forms a left support 6 with a rectangular vertical cross-section extending horizontally from the sewing portion of the sewing machine located ahead in the fabric feeding direction toward the operator, with the upper surface of .the support 6 forming the same plane as the upper surface of the bed 5. The upper and lower portions of the left side surface of the left support 6 rotatably support round bar arms 7 and 8, respectively, which are spaced from and parallel with each other and also parallel with the upper surface of the left support 6.

A base 9 disposed at a certain distance to the right from the arm 1 and the bed 5 supports a movable table 10 which is movable in the left and right (transverse) directions.

As shown in FIGS. 1 and 2, the movable table 10 supports a right support 14 disposed to the right of the left support 6 in parallel therewith and comprising a vertically extending frame 11 with a fixed upper end, and round bar arms 12 and 13 rotatably supported by the upper and lower ends of the vertical frame, respectively, and extending in parallel with the arms 7 and 8 of the left support 6.

A left base plate 15 is secured in place at a certain distance to the left from the arm 1 and the bed 5, and actuators 16 and 17 spaced away from each other and disposed in parallel with the left support 6 are secured to the left base plate 15. Each actuator 16 or 17 comprises a cylinder having a piston which is movable in the back and forth (longitudinal) directions in response to a pressure fluid or an electromagnetic force.

An actuator 18 comprising a cylinder having a piston which is movable left and right in response to a pressure fluid or an electromagnetic force is secured to the end of the piston shaft of the actuator 16 that is away from the actuator 16. A left A clamp plate 19 is fixed to the right end of the piston shaft of the actuator 18. The left A clamp plate 19 is formed of a U-shaped thin plate and has upper and lower portions which are parallel with the upper and lower arms 7 and 8, respectively, of the left support 6 and are curved in conformity with the circular curve of the arms 7 and 8.

An actuator 20 having the same structure as the actuator 18 is fixed to the piston shaft of the actuator 18, and a left B clamp plate 21 having the same structure as the left A clamp plate 19 is fixed to the right end of the piston shaft of the actuator 20.

An actuator 22 comprising a cylinder having a piston which is movable left and right in response to a pressure fluid or an electromagnetic force is secured to the end of the piston shaft of the actuator 17 that is away from the actuator 17. A left C clamp plate 23 is fixed to the right end of the piston shaft of the actuator 22. The left C clamp plate 23 is formed of a U-shaped thin plate and has upper and lower portions which are parallel with the upper and lower arms 7 and 8, respectively, of the left support 6 and are curved in conformity with the circular curve of the arms 7 and 8. This left C clamp plate 23 is disposed to the left of the left A clamp plate 19 in parallel therewith.

An actuator 24 comprising a cylinder having a piston which is movable left and right in response to a pressure fluid or an electromagnetic force is fixed to an intermediate portion of the piston shaft of the actuator 22, and a left D clamp plate 25 is fixed to the right end of the piston shaft of the actuator 24. The left D clamp plate 25 is formed of a flat plate disposed in parallel to the left side surface of the left support 6 and is shaped so as to correspond to the gaps between the respective upper and lower portions of the left A and B clamp plates 19 and 21.

A pulse motor 26 is secured to the base 9, which is operable to rotate a screw screwed into the right side of the movable table 10 in the forward and reverse directions so as to move the movable table 10 left and right.

Two actuators 27 and 28 spaced away from each other and disposed in parallel with the right support 14 are secured to the movable table 10. Each actuator 27 or 28 has the same structure as the corresponding left actuator and incorporates a piston which is movable in the back and forth direction.

An actuator 29 having the same structure as the corresponding actuator and incorporating a piston which is movable left and right is secured to the end of the piston shaft of the actuator 27 that is away from the actuator 27. A right A clamp plate 30 is fixed to the left end of a piston shaft of the actuator 29. The right A clamp plate 30 is formed of a U-shaped thin plate and has upper and lower portions which are parallel with the upper and lower arms 12 and 13, respectively, of the right support 14 and are curved in conformity with the circular curve of these arms. An actuator 31 having the same structure as the actuator 29 and incorporating a piston which is movable left and right is fixed to an intermediate portion of the piston shaft of the actuator 29. A right B clamp plate 32 has the same structure as the right A clamp plate 30 and is fixed to the left end of the piston shaft of the actuator 31.

An actuator 33 having the same structure as the corresponding actuator and having a piston which is movable left and right is secured to the end of the piston shaft of the actuator 28 that is away from the actuator 28. A right C clamp plate 34 is fixed to the left end of the piston shaft of the actuator 33. The right C clamp plate 34 is parallel to the right B clamp plate 32, has the same structure as the clamp plate 32, and is shaped like an inverted letter U.

An actuator 35 having the same structure as the corresponding actuator and incorporating a piston which is movable left and right is fixed to an intermediate portion of the piston shaft of the actuator 33, and a right D clamp plate 36 is fixed to the left end of the piston shaft of the actuator 35. The right D clamp plate 36 is formed of a flat plate disposed in parallel to the right side surface of the right support 14 and shaped so as to correspond to the gaps between the respective upper and lower portions of the right A, B, and C clamp plates 30, 32, and 34.

An actuator 37 having the same structure as the actuator 29, 31, 33, or 35 and incorporating a piston which is movable left and right is fixed to the edge of the movable table 10 that is closer to the operator. A right E clamp plate 38 which is parallel with the right side surface of the right support 14 is fixed to the left end of the piston shaft of the actuator 37.

Preprogrammed output signals of a microcomputer or a combination of timers are coupled with each actuator on both sides so as to cause each clamp plate at the left and right positions to operate as described in the following section, thereby to supply or discharge pressure fluid or electromagnetic force.

Figure 3:
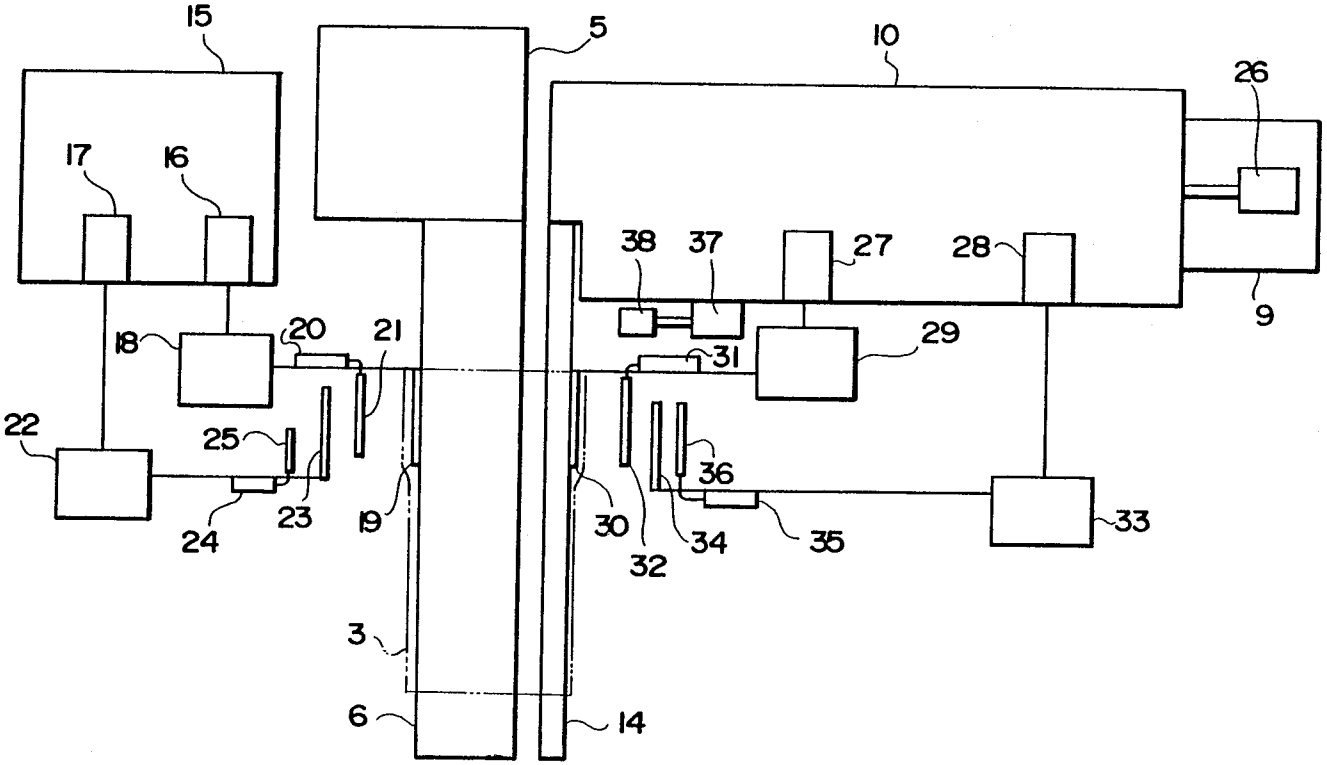
FIGS. 3 to 11 are top plan views illustrating the operational conditions of the fabric and essential parts of the apparatus, respectively.

The embodiment according to the present invention has the aforementioned arrangement. An explanation of the operation is described as follows with particular reference to FIGS. 3 et seq.

a. As shown in FIG. 3, the right A clamp plate 30 is caused to come into contact with the right side surface of the right support 14 at a position on the operator's side of the bed 5 by reciprocal movement of the piston of the actuator 29. The right B, C, D, and E clamp plates 32, 34, 36, and 38 are kept stationary at their respective positions each opposed to the right A clamp plate 30 and successively spaced therefrom to the right.

The left A clamp plate 19 is caused to come into contact with the left side surface of the left support 6 at a longitudinal position corresponding to that of the right A clamp plate 30 by reciprocal movement of the piston of the actuator 18. The left B, C, and D clamp plates 21, 23, and 25 are kept stationary at their respective positions each opposed to the left A clamp plate 19 and successively spaced therefrom to the left.

As indicated by the two-dot chain lines shown in FIG. 3, the inner surface of the fabric 3 which has been made in advance into a cylindrical shape by sewing both linear side edges of a flat piece of fabric is inserted around the peripheral surfaces of the left and right supports 6 and 14 from the operator's side to the sewing portion with the surface which will become the upper face of the apparel facing outward. The inner surface of the fabric 3 is caused to cover the left A and right A clamp plates 19 and 30.

Figure 4:
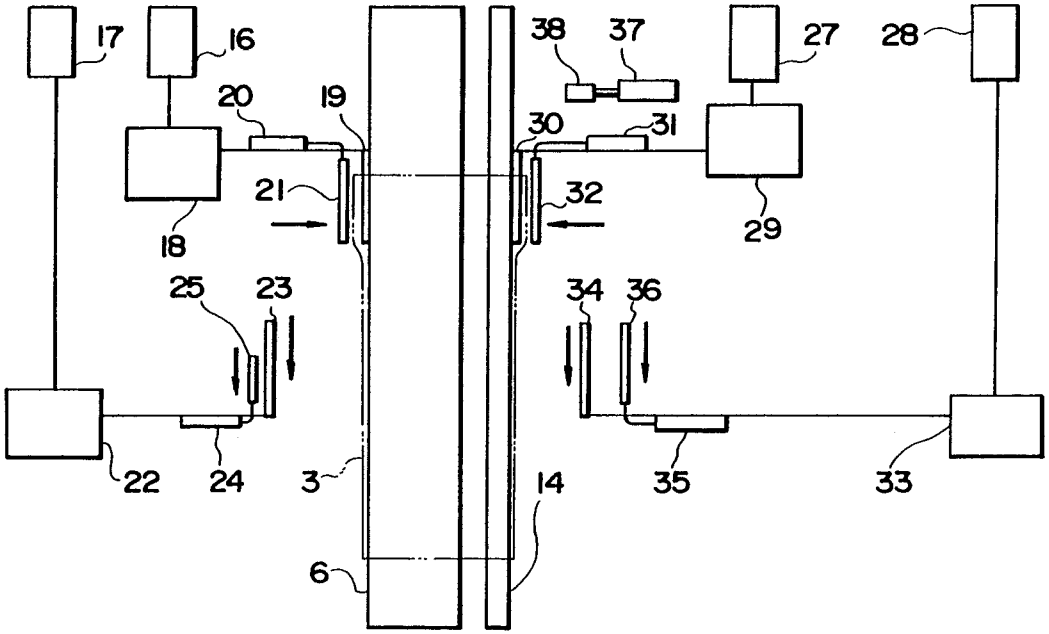
Figure 5:
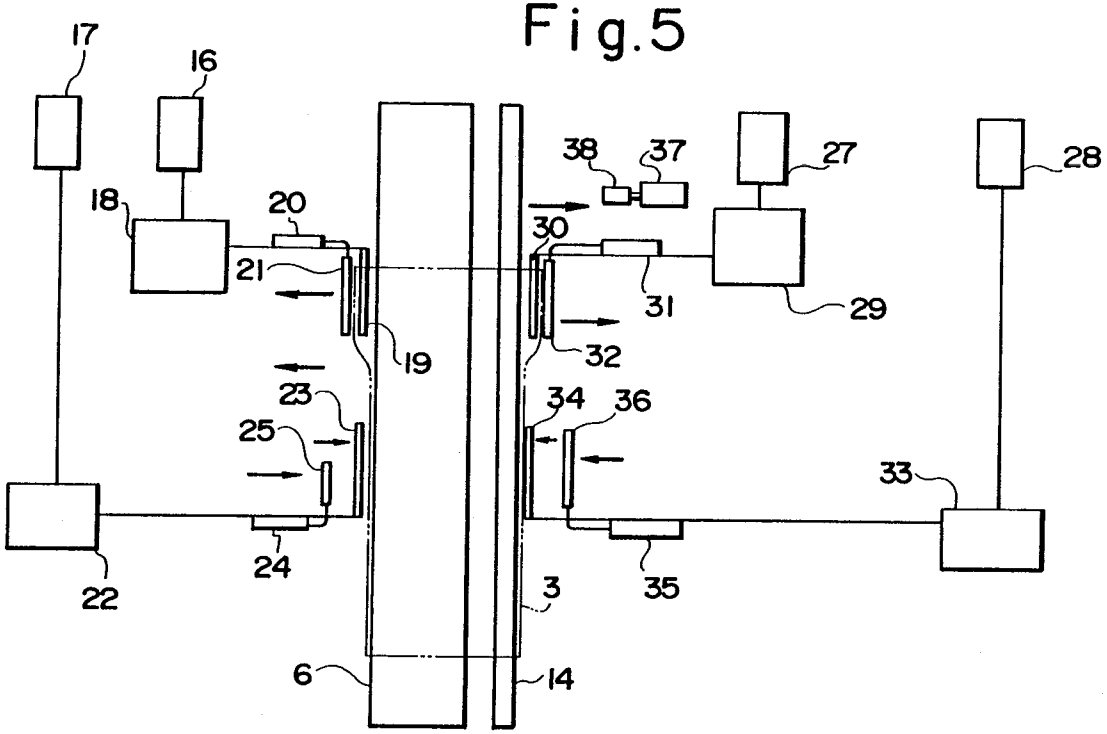
Figure 6:
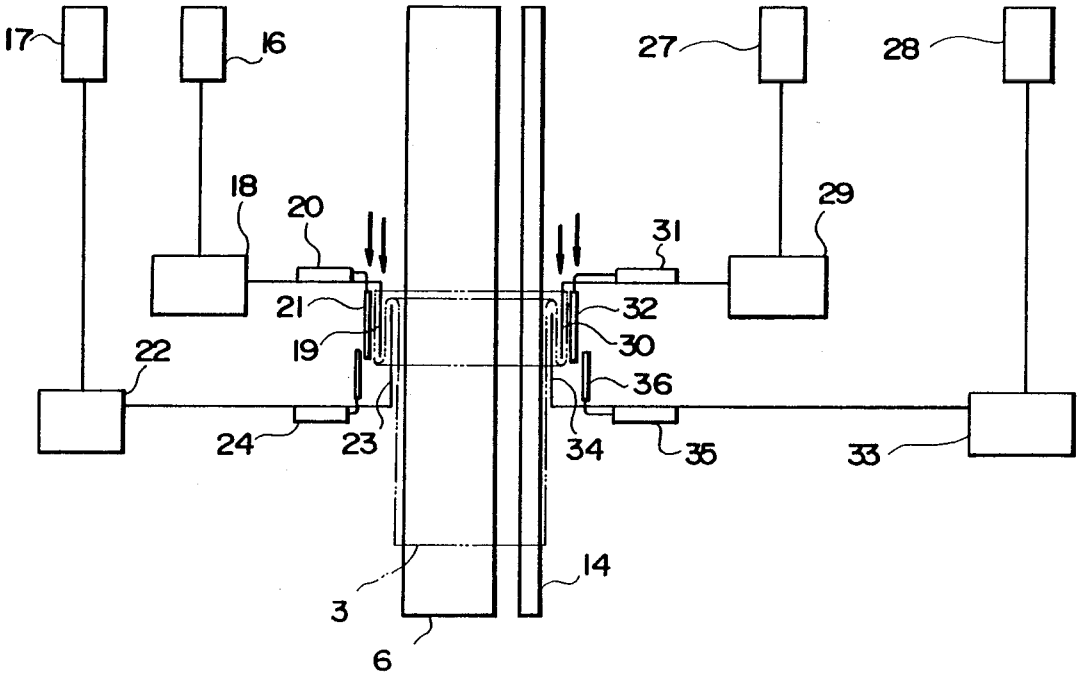

In order to adjust the support provided by the left and right supports 6 and 14 to the inner diameter of the cylindrically shaped fabric 3, the pulse motor 26 is rotated in the forward and reverse directions so as to cause the movable table 10 to move to the left and right together with the right support 14. Thereafter, the movable table 10 is stopped.

b. As shown in FIG. 4, the right B clamp plate 32 is moved to the left by reciprocal movement of the piston of the actuator 31 so as to clamp the cylindrically shaped piece of fabric 3 in cooperation with the right A clamp plate 30. The right C clamp plate 34 is moved toward the operator by reciprocal movement of the piston of the actuator 28 together with the right D clamp plate 36, while the left C clamp plate 23 is moved toward the operator by reciprocal movement of the piston of the actuator 17 together with the left D clamp plate 25. The left B clamp plate 21 is moved to the right by reciprocal movement of the piston of the actuator 20 so as to clamp the cylindrically shaped piece of fabric 3 in cooperation with the left A clamp plate 19.

c. As shown in FIG. 5, the left A clamp plate 19 is moved slightly to the left by the operation of the actuator 18 together with the left B clamp plate 21, with a corresponding portion of the cylindrical piece of fabric 3 being clamped therebetween, and is then stopped. By virtue of this movement, the left side of the forward portion of the cylindrical piece of fabric 3 is slightly moved away from the left support 6 to the left and is thus expanded. Simultaneously, the right A clamp plate 30 is moved slightly to the right by the operation of the actuator 29 together with the right B clamp plate 32, with a corresponding portion of the cylindrical piece of fabric 3 being clamped therebetween, and is then stopped. By virtue of this movement, the right side of the forward portion of the cylindrical piece of fabric 3 is slightly moved away from the right support 14 to the right and is thus expanded.

Figure 7:
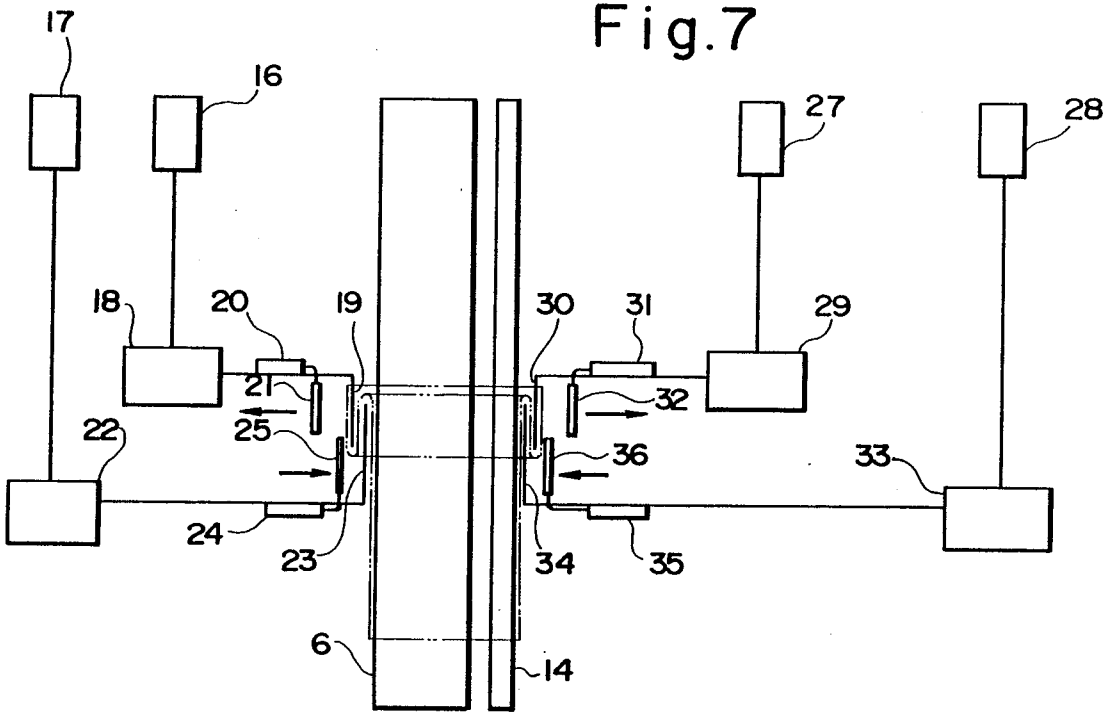

Also in the condition shown in FIG. 5, the left C clamp plate 23 is moved to the right by reciprocal movement of the piston of the actuator 22 together with the left D clamp plate 25, and is then stopped at a position at which the clamp plate 23 clamps a left intermediate portion of the cylindrical piece of fabric 3 in cooperation with the left support 6. Similarly, the right C clamp plate 34 is moved to the left by reciprocal movement of the piston of the actuator 33 together with the right D clamp plate 36, and is then stopped at a position at which the clamp plate 34 clamps a right intermediate portion of the cylindrical piece of fabric 3 in cooperation with the right support 14.

d. The left A clamp plate 19 and the left B clamp plate 21 are both moved by reciprocal movement of the piston of the actuator 16 toward the operator to positions opposed to the left C clamp plate 23 at a slight distance therefrom to the left, while the right A and B clamp plates 30 and 32 are both moved by reciprocal movement of the piston of the actuator 27 toward the operator to positions opposed to the right C clamp plate 34 at a slight distance therefrom to the right. By virtue of this movement, the entire forward portion of the cylindrical piece of fabric 3 is twice folded into three layers. In this operation, the actuators 16 and 27 causes simultaneous reciprocal movement.

e. As shown in FIG. 7, the left D clamp plate 25 is moved to the right by reciprocal movement of the piston of the actuator 24 so as to press a left portion of twice-folded three layers of the cylindrical piece of fabric 3 which is at the gaps between the respective upper and lower portions of the U-shaped left A and B clamp plates 19 and 21 against the left support 6. Simultaneously, the right D clamp plate 36 is moved to the left by reciprocal movement of the piston of the actuator 35 so as to press a right twice-folded three-layered portion of the fabric 3 which is at the gaps between the respective upper and lower portions of the U-shaped right A and B clamp plates 30 and 32 against the right support 14.

Figure 8:
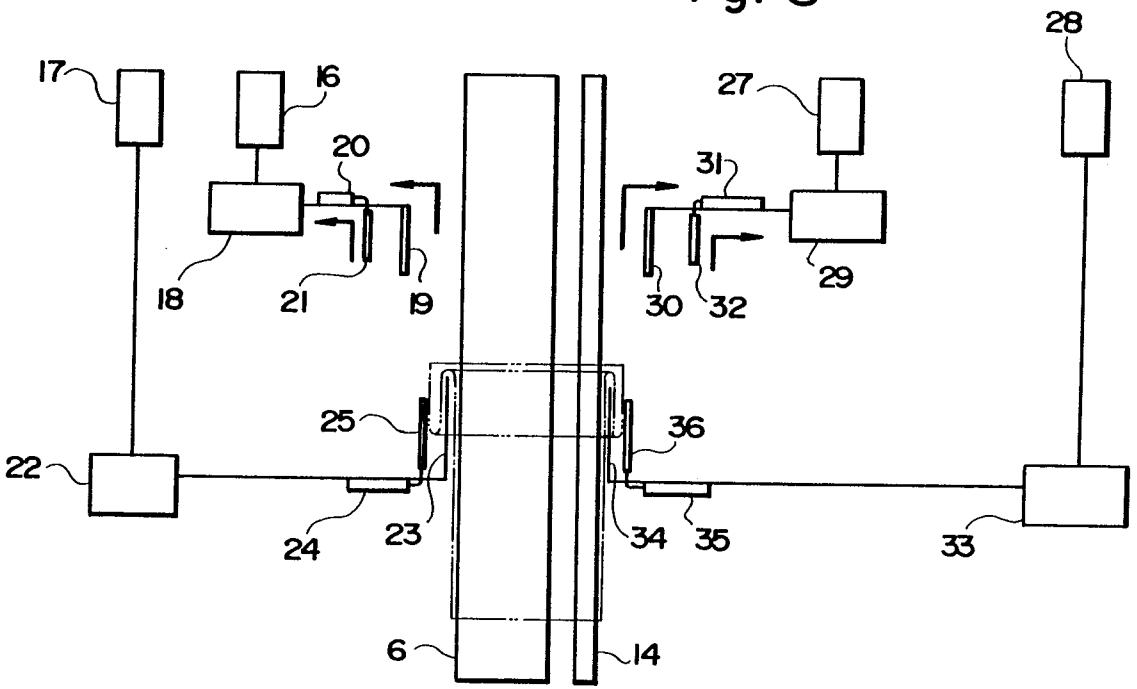
Figure 9:
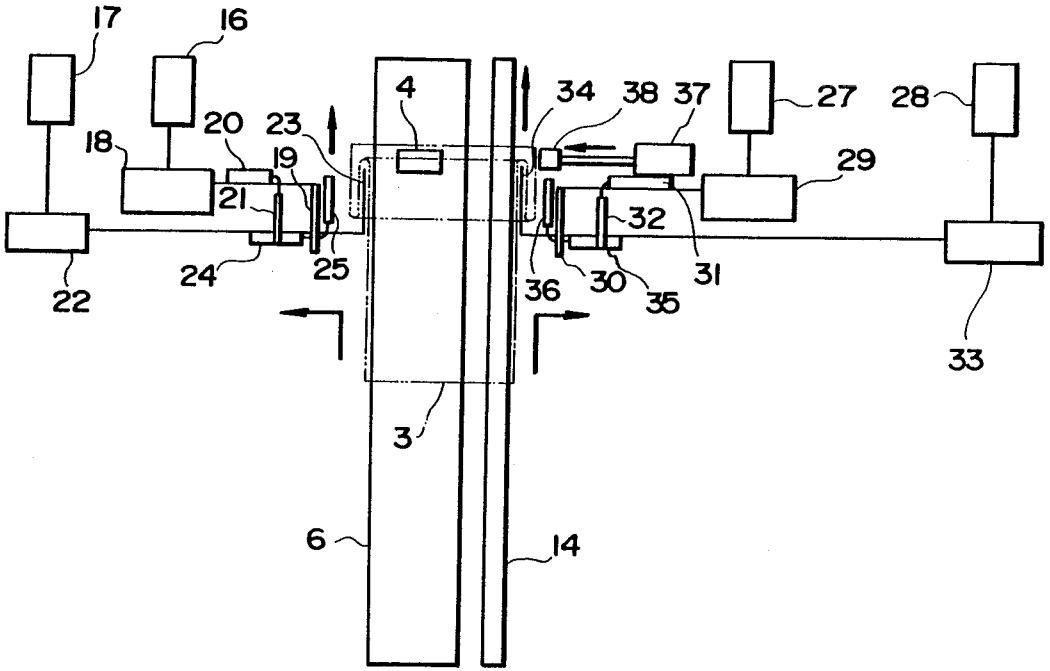

Thereafter, the left B clamp plate 21 is moved to the left by the operation of the actuator 20 so as to be detached from the left twice-folded three-layered portion of the cylindrical piece of fabric 3, and the right B clamp plate 32 is also moved to the right by the operation of the actuator 31 so as to be detached from the right twice-folded three-layered portion of the fabric 3.

f. As shown in FIG. 8, after both the left A clamp plate 19 and the left B claim plate 21 have been moved forward by the operation of the actuator 16 so as to be pulled out from the layered portion of the cylindrical piece of fabric 3, these clamp plates 19 and 21 are moved to the left by the operation of the actuator 18. Similarly, after the right A clamp plate 30 and the right B clamp plate 32 have been moved forward by the operation of the actuator 27 so as to be pulled out from the layered portion of the fabric 3, these clamp plates 30 and 32 are moved to the right by the operation of the actuator 29. In this operation, a pair of actuators 16 and 27 and another pair of actuators 18 and 29 are each made to cause simultaneous reciprocal movement.

g. As shown in FIG. 9, both the left C clamp plate 23 and the left D clamp plate 25 are moved forward by the operation of the actuator 17, while both the right C clamp plate 34 and the right D clamp plate 36 are moved forward by the operation of the actuator 28, whereby the twice-folded, three-layered portion of the cylindrical piece of fabric 3 is moved forward along the left and right supports 6 and 14 to a position immediately below the presser foot 4 of the sewing portion of the sewing machine.

Subsequently, the presser foot 4 is lowered to the forward portion of the cylindrical piece of fabric 3 which includes the twice-folded three layers so as to press this portion of the cylindrical piece of fabric 3. Simultaneously, the right E clamp plate 38 is moved to the left by the operation of the actuator 37 so as to press the right side of the twice-folded, three-layered portion of the cylindrical piece of fabric 3 against the right support 14.

Figure 10:
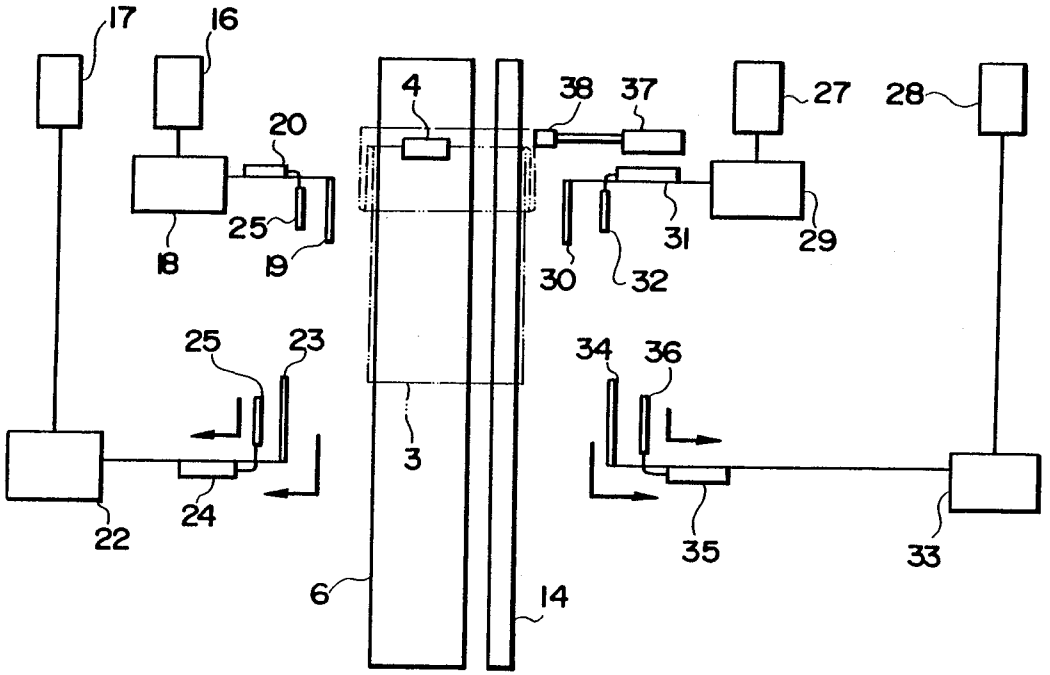

Thereafter, both the left D clamp plate 25 and the right D clamp plate 36 are simultaneously moved to the left and right, respectively, by the operation of the corresponding actuators 24 and 35 so as to be detached to the left and right, respectively.

h. As shown in FIG. 10, the left C clamp plate 23 as well as the left D clamp plate 25 are moved backward by the operation of the actuator 17, thereby pulling the clamp plate 23 out from the layered portion of the cylindrical piece of fabric 3 and, simultaneously, the right C clamp plate 34 as well as the right D clamp plate 36 are moved backward by the operation of the actuator 28, thereby pulling the clamp plate 36 out from the layered portion of the cylindrical piece of fabric 3.

Figure 11:
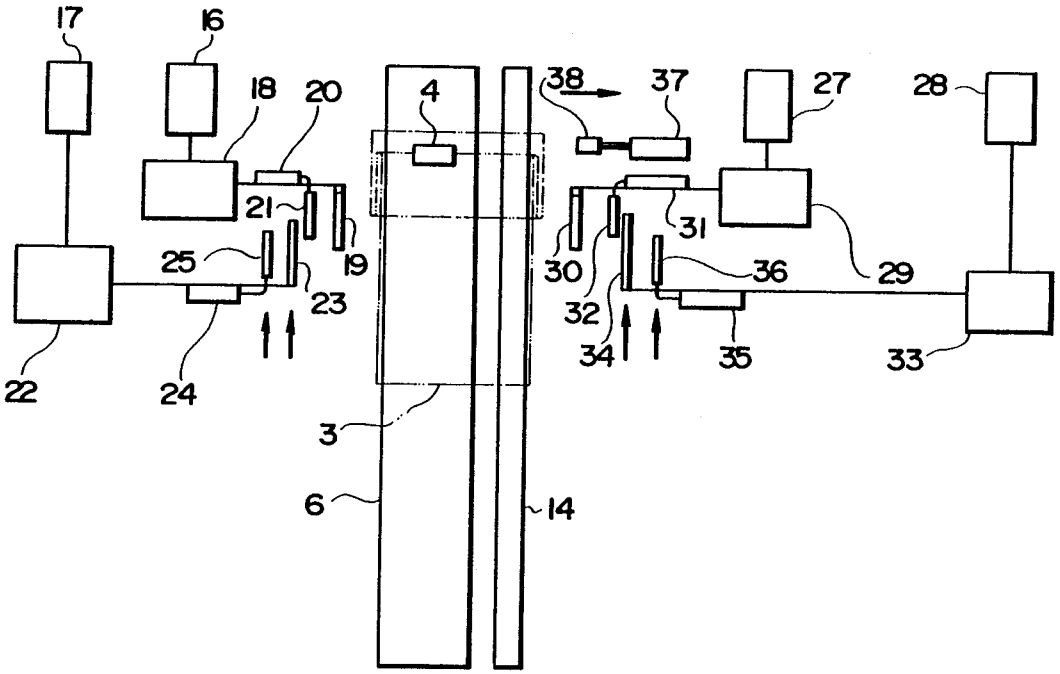
Figure 12A:
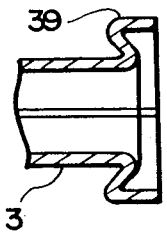
FIG. 12A is a sectional view showing a twice-folded three-layered band at the edge of a cylindrically shaped piece of fabric.
Figure 12B:
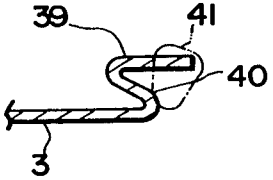
FIG. 12B is a partial sectional view showing the overlock stitching.
Figure 12C:
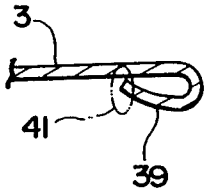
FIG. 12C is a partial sectional view showing a stitched and unfolded edge of the fabric.

Thereafter, the left C and D clamp plates 23 and 25 are moved together to the left by the operation of the actuator 22 and, simultaneously, the right C and D clamp plates 34 and 36 are moved together to the right by the operation of the actuator 33.

i. As shown in FIG. 11, the left C and D clamp plates 23 and 25 are moved forward together by the operation of the actuator 17 and, simultaneously, the right C and D clamp plates 34 and 36 are moved forward by the operation of the actuator 28. In addition, the right E clamp plate 38 is moved to the right by the operation of the actuator 37 so as to be detached from the twice-folded, three-layered portion of the cylindrical piece of fabric 3.

j. As shown in FIGS. 12A, 12B, and 12C, when the sewing machine is started, the needle 2 is vertically moved, the looper is operated, the feeding gear is moved vertically and transversely, and the cylindrically shaped piece of fabric 3 is fed leftward along its circumference. While the piece of fabric 3 is being fed, the needle 2 is lowered through the cylindrical piece of fabric 3 from the above and slightly innerward, i.e. leftward as viewed in FIG. 12A, of the edge of the outermost layer 39 of the three-layered portion of the piece of fabric 3 to the middle of the thickness of the fold 40 forming the inner two layers, whereby a hem-stitch seam is formed at the edge of the outermost layer 39 and a concealed seam is formed at the inner fold 40, these seams constituting a lapped-edge stitch seam. After the entire circumference of the cylindrical piece of fabric 3 has been sewn in this way, the sewing machine is stopped, and the needle 2 and the presser foot 4 are raised from the piece of fabric and are then held at their raised positions. The piece of fabric 3 is moved toward the operator and is removed from the left and right supports 6 and 14. Subsequently, the outermost layer 39 and the adjacent layer are turned over to the right, as viewed in FIG. 12B, with the seam 41 on the fold 40 serving as a fulcrum, and the cylindrical piece of fabric 3 with a double-layered edge portion (FIG. 12C) is used as a sleeve for apparel having a double-layered cuff.

Since the apparatus according to the present invention has the aforementioned arrangement and operates as stated above, the apparatus has the following effects.

a. Since a cylindrical piece of fabric 3 is fed to a sewing portion of a hem-stitching sewing machine after one edge portion of the cylindrical piece of fabric 3 has been formed into a twice-folded, three-layered band mechanically and automatically, the following advantages are obtained, even if the cylindrical piece of fabric 3 is, for instance, a sleeve of a child's shirt having an extremely small diameter; it is unnecessary to use a fabric end-lapping tool and to manually handle the piece of fabric for sewing it while inserting it into the tool so as to fold it, this sewing operation requiring skill; the fabric edge detector for detecting the edge of the piece of fabric which operates to move the piece of fabric until the edge is accurately positioned in correspondence with the needle of the sewing portion of the sewing machine is prevented from serving as an obstacle or is made unnecessary; and it is possible to perform accurate and smooth lapped-edge stitching of a cylindrical piece of fabric having a small diameter.

b. In the conditions shown in FIGS. 9 and 10 wherein the operation described in items g. and h. is performed, the left D and right D clamp plates 25 and 36 detach from the twice-folded three-layered portion of the piece of fabric 3 to the left and to the right, respectively, after the presser foot 4 has been moved so as to press from above the same portion of the piece of the fabric 3 against the left support 6 and meanwhile the right E clamp plate 38 has been moved so as to press the same portion against the right support 14 particularly from the right side. By virtue of this arrangement, when the left C and right C clamp plates 23 and 34 are drawn toward the operator from the piece of fabric 3, only these clamp plates can be removed easily, without any portion of the twice-folded three layers of the piece of fabric being pulled in the clamp plate removing direction or pulled one-sidedly. Thus, this arrangement enables the twice-folded three-layered portion to positively maintain its shape, thereby ensuring positive lapped-edge stitching.

c. As shown in FIGS. 2 and 3, since the right support 14 is able to move and stop together with the movable table 10 by rotation of the pulse motor 26 in the forward and reverse directions, the apparatus can be adjusted in response to a change in the inner diameter of the cylindrical piece of fabric 3.

d. In the conditions shown in FIGS. 8 and 9 wherein the operation described in items f. and g. is performed, because neither of the left and right support 6 and 14 is moved forward but is kept stationary, and because the twice-folded three-layered portion of the piece of fabric 3 is firmly clamped on its both sides by left C and D clamp plates 23 and 25 and right C and D clamp plates 34 and 36, respectively, the piece of fabric 3 can be moved forward evenly while the shape of the folded portion is positively maintained, without any slippage occurring or any risk of the folded portion collapsing. The folded portion which has thus been fed to the sewing portion of the sewing machine can be subjected to positive forming of overcasting stitches.

e. In the conditions shown in FIGS. 4 to 9 wherein the operation described in items b. to g. is performed, both sides of the forward portion of the cylindrical piece of fabric 3 are stretched to the left and right and are then moved toward the operator while the sides of the same are firmly clamped between the left A and B clamp plates 19 and 21 and the right A and B clamp plates 30 and 32, respectively. By virtue of this arrangement, the forward portion can be stretched to the left and right evenly without any slippage, and then be moved toward the operator, thus enabling accurate formation of the twice-folded, three-layered band.

f. In the condition shown in FIG. 4 wherein the operation described in item b is performed, the right C and D clamp plates 34 and 36 are merely moved to longitudinal positions corresponding to those of the left C and D clamp plates 23 and 25, in contrast with a proposal previously made by the present applicant and disclosed in Japanese Patent Laid-Open no. 122888/1986, and eliminating the step necessitated by this prior art of longitudinally moving the right C clamp plate back to a position corresponding to that of the left B clamp plate after the former has been moved to a longitudinal position beyond the left B clamp plate toward the operator. In addition, while the above prior art necessitates eleven steps in the operation of the left and right clamp plates, the arrangement of the present invention requires only the 8 steps shown in FIGS. 4 to 11 respectively. As a result, it is possible to simplify the process of forming one edge of the cylindrical piece of fabric into the twice-folded, three-layered band for the lapped-edge stitching and the process of feeding the thus prepared piece of fabric to the sewing portion of the sewing machine, while curtailing the time required for the operation and thus improving work efficiency.

What is claimed is:

1. A method of feeding a piece of fabric to a sewing machine, comprising the steps of:

a. sewing one edge of a piece of flat-shaped fabric to the opposite edge thereof so as to make said piece of fabric into a cylindrical shape;

b. inserting the inner periphery of said cylindrical piece of fabric around a holder extending from a sewing portion of the sewing machine from the side of said holder that is away from said sewing portion forward to said sewing portion so as to support said cylindrical piece of fabric around said holder;

c. first clamping left and right portions of the longitudinally forward portion of said cylindrical piece of fabric which is closer to said sewing portion respectively from the inside and outside and subsequently stretching the thus first clamped portions of said cylindrical piece of fabric from the inside toward the outside, so that the thus stretched portions are slightly expanded in the left and right directions;

d. second clamping left and right portions of a longitudinally intermediate portion of the outer periphery of said cylindrical piece of fabric onto said holder from the outside;

e. moving said stretched portions of said piece of fabric in the stretched state toward the thus second clamped intermediate portions until said stretched portions are disposed over the outside of said second clamped intermediate portions, so that said cylindrical piece of fabric is folded twice and the edge of said piece of fabric on the outermost side slightly projects longitudinally from the edge of an inner folded clamped portion of said piece of fabric;

f. first pressing left and right portions of the thus folded portion of said piece of fabric respectively from the inside and outside;

g. releasing the first clamping and then the stretching of said piece of fabric while said piece of fabric is being subjected to the first pressing;

h. moving the thus first pressed portion of said piece of fabric in the pressed state forwardly to said sewing portion in parallel with said holder;

i. second pressing an upper surface of said first pressed portion of said piece of fabric and a lateral portion of said first pressed portion of said piece of fabric onto said holder;

j. releasing the second clamping and then the first pressing of said folded portion of said piece of fabric; and k. releasing the second pressing of said piece of fabric.

2. A method as set forth in claim 1, wherein said clamping of said piece of fabric and said releasing is performed by a plurality of clamp plates forming pairs successively spaced outwardly from said holder, each said clamp plate being disposed to the left and right and forward and backward of said holder and movable in the left and right directions and in the back and forth directions.

3. A method as set forth in claim 2, wherein said steps e. and f respectively comprise: moving backward first pairs of said clamp plates disposed to the left and right of said holder at forward positions in the back and forth direction until said first pairs of clamp plates are placed between second pairs of said clamp plates disposed to the left and right of said holder at backward positions in the back and forth direction; and causing said first pairs of clamp plates to oppose said second pairs of clamp plates on the respective sides of said holder, thereby first pressing said left and right portions of said folded portion of said cylindrical piece of fabric from the inside and outside.

4. A method as set forth in claim 3, wherein said step g. comprises moving the outer pair of said first pairs of clamp plates respectively to the left and right and subsequently moving the inner pair of said first pairs of clamp plates in the back and forth direction, thereby releasing said first clamping and stretching, and said step h. comprises moving said cylindrical piece of fabric in the state of being pressed between said second pairs of clamp plates toward said sewing portion.

5. A method as set forth in claim 1, wherein part of said second pressing and said releasing thereof are performed by a clamp plate disposed on one side of said holder at a position opposed to said sewing portion and movable in the left and right directions.

* * * * *